US007843180B1

(12) United States Patent
Cilingiroglu

(10) Patent No.: US 7,843,180 B1
(45) Date of Patent: Nov. 30, 2010

(54) MULTI-STAGE LINEAR VOLTAGE REGULATOR WITH FREQUENCY COMPENSATION

(75) Inventor: Ugur Cilingiroglu, Istanbul (TR)

(73) Assignee: Lonestar Inventions, L.P., Austin, TX (US)

( * ) Notice: Subject to any disclaimer, the term of this patent is extended or adjusted under 35 U.S.C. 154(b) by 294 days.

(21) Appl. No.: 12/101,382

(22) Filed: Apr. 11, 2008

(51) Int. Cl.
*G05F 1/44* (2006.01)
*G05F 1/618* (2006.01)

(52) U.S. Cl. ..... 323/274; 323/273; 323/277

(58) Field of Classification Search ..... 323/274, 323/273, 277
See application file for complete search history.

(56) References Cited

U.S. PATENT DOCUMENTS 6,188,212 B1 * 2/2001 Larson et al. ..... 323/281
6,201,375 B1 * 3/2001 Larson et al. ..... 323/277
6,300,749 B1 10/2001 Castelli et al.
6,522,111 B2 * 2/2003 Zadeh et al. ..... 323/277
6,556,083 B2 4/2003 Kadanka
6,603,292 B1 * 8/2003 Schouten et al. ..... 323/277
6,707,340 B1 3/2004 Gough
6,784,698 B1 * 8/2004 Brenden ..... 327/51
7,173,401 B1 2/2007 Huang
7,521,909 B2 * 4/2009 Dow et al. ..... 323/280
7,652,455 B2 * 1/2010 Demolli ..... 323/274
2003/0102851 A1 * 6/2003 Stanescu et al. ..... 323/280
2003/0111986 A1 * 6/2003 Xi ..... 323/280
2006/0164047 A1 * 7/2006 Ressel ..... 323/222
2007/0241730 A1 * 10/2007 Dow et al. ..... 323/280
2007/0285075 A1 * 12/2007 Dow et al. ..... 323/295

OTHER PUBLICATIONS

Lai, et al., "A 3-A CMOS low-dropout regulator with adaptive Miller compensation," Analog Integr Circ Sig Process (2006) 49:5-10.

* cited by examiner

*Primary Examiner*—Bao Q Vu
(74) *Attorney, Agent, or Firm*—Townsend and Townsend and Crew LLP; Kenneth R. Allen

(57) ABSTRACT

A two-gain-stage linear error amplifier is provided with frequency compensation and independently selectable stage gains and a reasonably small compensation capacitor to promote stability with a reasonable phase margin over a wide load range so that the invention is useful as a low drop out (LDO) voltage regulator circuit device that is stable over a wide load range.

6 Claims, 5 Drawing Sheets

MULTI-STAGE LINEAR VOLTAGE REGULATOR WITH FREQUENCY COMPENSATION

CROSS-REFERENCES TO RELATED APPLICATIONS

NOT APPLICABLE

STATEMENT AS TO RIGHTS TO INVENTIONS MADE UNDER FEDERALLY SPONSORED RESEARCH AND DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

This invention relates multi-stage linear amplifiers subject to widely varying load conditions and particularly to stabilized linear voltage regulator circuits, and more particularly low drop-out (LDO) linear voltage regulator circuits incorporating stabilization.

Shown in FIG. 1 is a conventional circuit topology of an LDO. A PMOS pass device $M_P$ receives unregulated input voltage $V_{IN}$ at the source terminal S. The load of the LDO regulator, represented by resistance $R_L$, is tied to the drain terminal D of M. Regulated output voltage $V_{OUT}$ generated at the drain of $M_P$ is divided between resistors $R_1$ and $R_2$, and the resulting feedback voltage $V_{FB}$ is compared with a reference voltage $V_{REF}$ at the inputs of a high-gain error amplifier $A_E$ of voltage gain A. The output voltage $V_A$ of $A_E$ drives the gate of $M_p$ to close the negative feedback loop needed for regulating the output voltage. Capacitor $C_L$ shown in parallel with the load serves the purpose of improving the transient response of the LDO regulator.

Unless supplemented with a proper frequency compensation scheme, the regulation loop of an LDO regulator cannot be stable with an adequate phase margin because the loop-gain transfer function (LGTF) contains at least two poles at frequencies lesser that its unity-gain frequency. The fact that the frequency of the load pole associated with the output of LDO regulator increases with load current $I_L$ further accentuates this problem.

A common frequency compensation technique applied to LDO regulator stabilization is to introduce a transfer function zero to the LGTF by utilizing a load capacitance CL with a parasitic equivalent series resistance (ESR). However, the ESR values needed for this purpose are available only in relatively expensive and bulky electrolytic or tantalum capacitors. Ceramic capacitors that are favored due to their low cost and small form factor are unsuitable for this purpose because their ESR is much lower than needed for stabilizing an LDO regulator. For this reason, an LDO regulator must be internally compensated if a ceramic load capacitor is to be deployed.

A common internal compensation technique used in prior art (U.S. Pat. No. 6,300,749B1, U.S. Pat. No. 6,556,083 B2, U.S. Pat. No. 6,603,292 B1, and U.S. Pat. No. 6,707,340 B1) is to modify the LGTF with a fixed-frequency pole and a zero whose frequency increases with load current IL. The adaptive zero compensates for the adverse effect of the variable load pole by tracking it. This technique is illustrated in FIG. 2. The error amplifier has a first gain stage AE1 and a second buffer stage AE2. A compensation network is connected between the output of the first stage and signal ground. This network is a series combination of a compensation capacitor CC of fixed capacitance, and a voltage-controlled resistor RC of variable resistance. Since CC blocks the dc path of RC, RC operates without any dc current. However, the conductance of RC is adjusted to be an increasing function of IL by a current-sensing bias circuit S. In this manner the frequency of the zero created by CC and RC is made an increasing function of IL.

The patents cited herein differ mainly in techniques for sensing the load current and for controlling the RC with the sensed current. However, they are all similar in deploying a buffering second stage. The very low output resistance of this stage helps move the pole at the input of MP to a frequency much higher than the unity-gain frequency of the LGTF despite the presence of a very large capacitance at this node. This pole thus ceases to be influential on stability. Since, however, low output resistance precludes high gain, a buffer stage can provide only a very limited gain close to unity. As an undesirable consequence of a buffering second stage, therefore, the error amplifier is left with a single gain the first stage to provide all or most of its overall loop gain. The overall loop gain is thus severely limited. A second undesirable property of a buffering second stage is that no simple buffer topology can match a simple gain stage in the extent of output range. A rail-to-rail output range is indeed needed for minimizing the footprint of the pass transistor while maintaining a wide load range with a small dropout voltage.

It is therefore highly desirable in LDO design to utilize an error amplifier with two high gain stages, none of which being a buffer, and still maintain stability with a reasonable phase margin over a wide load range.

SUMMARY OF THE INVENTION

According to the invention, a two-gain-stage linear error amplifier is provided with frequency compensation and independently selectable stage gains and a reasonably small compensation capacitor to promote stability with a reasonable phase margin over a wide load range so that the invention is useful as a low drop out (LDO) voltage regulator circuit device that is stable over a wide load range. By gain stage it is understood that neither stage is of necessity a buffer of unity or close-to-unity gain. It is nevertheless understood that the invention can function where the second stage is a buffer of unity or close-to-unity gain.

The invention will be better understood by reference to the following detailed description in connection with the accompanying drawing.

DETAILED DESCRIPTION OF SPECIFIC EMBODIMENTS OF THE INVENTION

Figure 1:
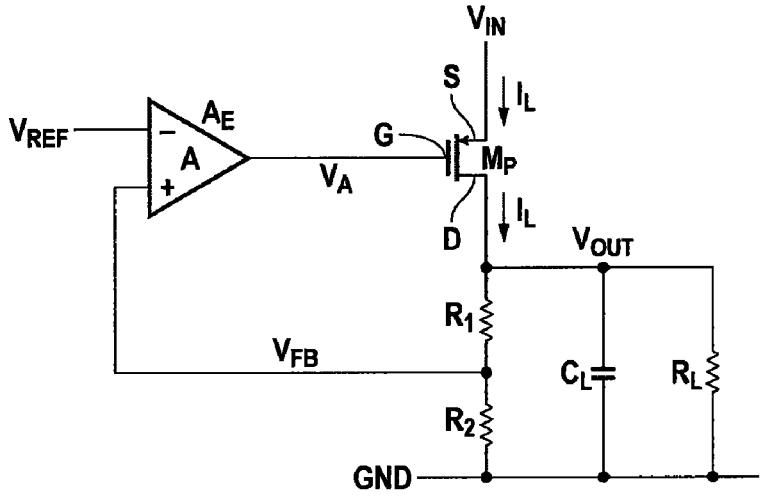
FIG. 1 (Prior Art)
FIG. 1 is a schematic diagram of an LDO voltage regulator of the prior art.
Figure 2:
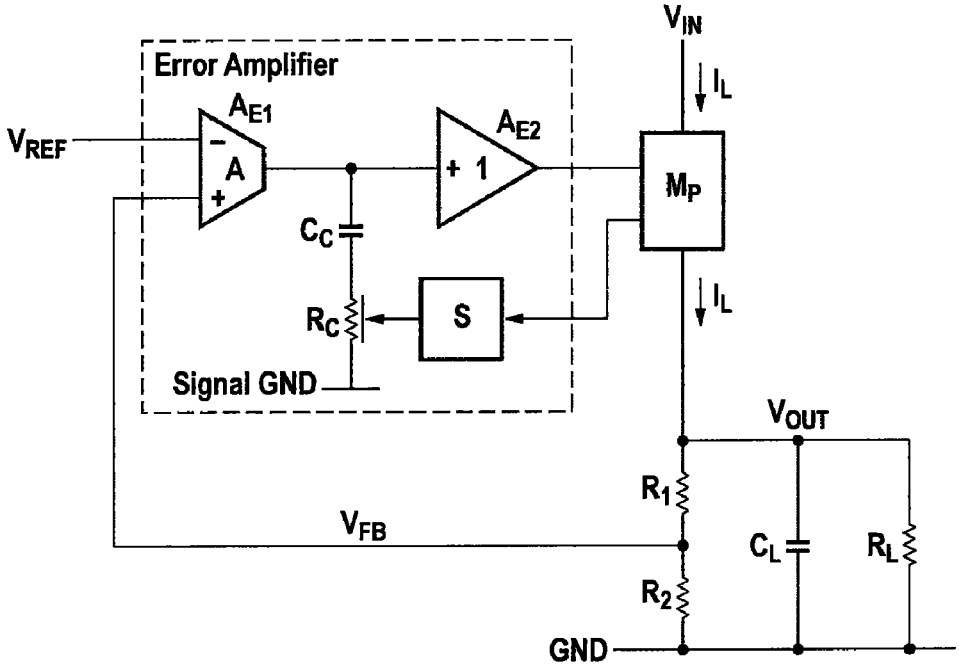
FIG. 2 (Prior Art)
FIG. 2 is a schematic and block diagram of a two stage LDO voltage regulator of the prior art.
Figure 3:
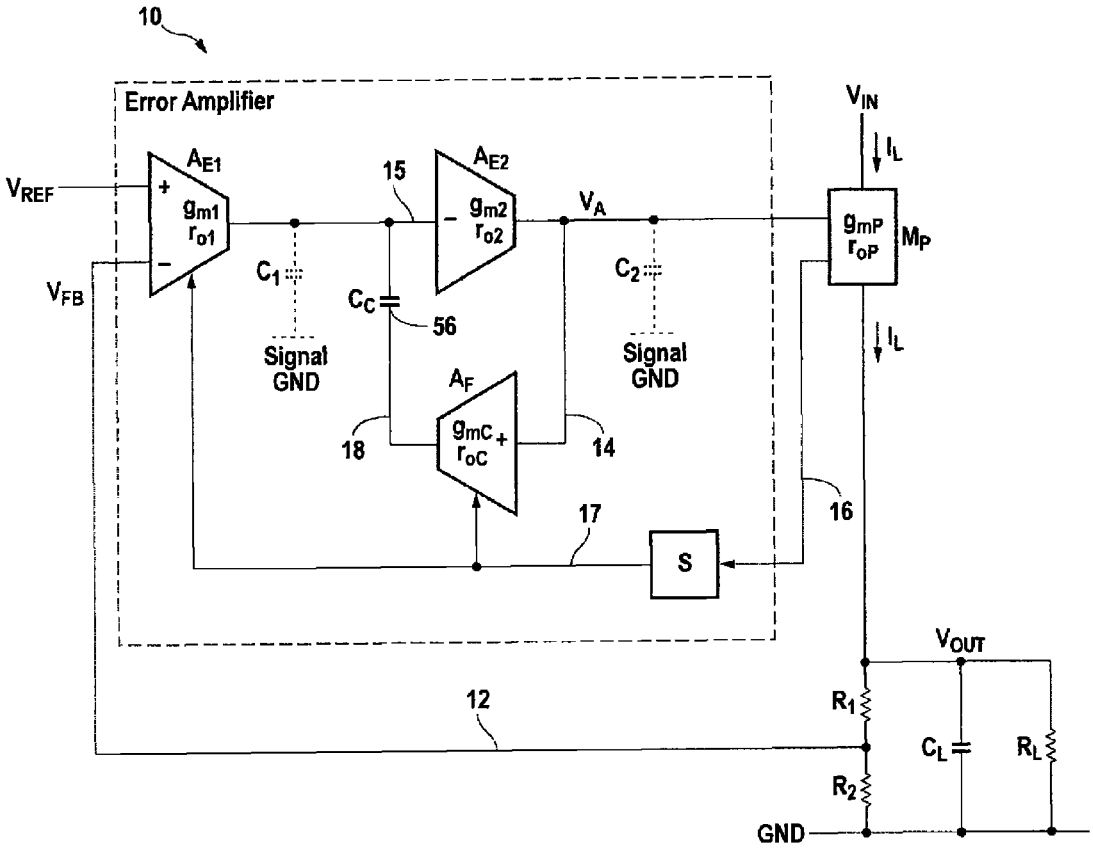
FIG. 3 is a schematic and block diagram of a two-gain-stage frequency compensated linear voltage regulator according to the invention.

FIG. 3 is an illustration of a specific embodiment of a two-gain-stage linear voltage regulator with error amplifier 10 with frequency compensation according to the invention. The object is to cause $V_{OUT}$ to track $V_{REF}$ over a wide loading range. The error amplifier 10 has first and second independent gain stages represented with $A_{E1}$ and $A_{E2}$. The transconductance and output resistance of the first stage are denoted by $g_{m1}$ and $r_{o1}$, respectively. The transconductance and output resistance of the second stage are denoted by $g_{m2}$ and $r_{o2}$, respectively. $C_1$ and $C_2$ are the parasitic capacitances at the output nodes of the first gain stage and second gain stage $A_{E1}$ and $A_{E2}$, respectively. The general LDO feedback loop 12 (aka regulation feedback path) is closed after dividing $V_{OUT}$ between $R_1$ and $R_2$ as in the prior art (FIG. 1 and FIG. 2), but this is not a necessity; it is quite possible to omit these two resistors, and feed $V_{OUT}$ directly back to the input of the error amplifier to equate $V_{OUT}$ to $V_{REF}$.

According to the invention, frequency compensation is applied with two additional feedback loops represented by traces 14, 18 and 16, 17. The first traces 14, 18 provide a loop through a compensation capacitor $C_c$ with a frequency compensating transconductor stage $A_F$ whose transconductance and output resistance are denoted by its $g_{mC}$ and $r_{oC}$. The stage $A_F$ senses the output signal, a voltage $V_A$, of the second gain stage $A_{E2}$ and drives the output node 15 of the first gain stage $A_{E1}$ via the compensation capacitor $C_C$, which is of a fixed capacitance. The second loop is provided through traces 16, 17 with a current-sensing bias circuit S, which together with the compensation capacitor $C_C$ and frequency compensating transconductor stage $A_F$ form a frequency compensation network that senses the load current $I_L$ and controls both $g_{m1}$, $r_{o1}$, $g_{mC}$ and $r_{oC}$ in accordance with the invention in such a way that each of these four parameters becomes a function of the load current $I_L$. This is depicted in FIGS. 4A-4D. The output resistance control characteristic of the first gain stage, with a maximum fixed resistance under light loading, as depicted in FIG. 4D, secures frequency compensation under light load conditions, significantly improving circuit stability in operation.

Load current $I_L$ may vary many orders of magnitude between a minimum $I_{L(min)}$ and a maximum $I_{L(max)}$. In consideration, it is more instructive to interpret the horizontal and vertical axes of the plots shown in FIGS. 4A-4D to be logarithmically calibrated. Furthermore, each plot shown must be interpreted as an asymptote to the actual variation of the associated parameter.

Figure 4A:
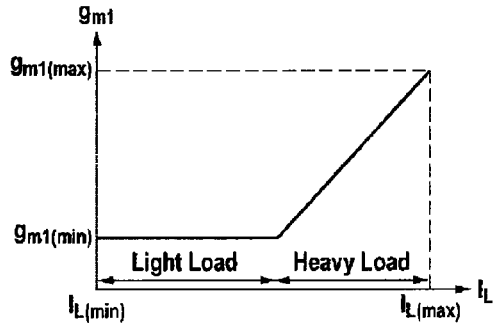
FIGS. 4A-4D are graphs showing transconductance and output resistance characteristics for the device of FIG. 3 according to the invention.

As observed in FIG. 4A, transconductance $g_{m1}$ remains at a minimum $g_{m1(min)}$ for relatively lighter load conditions of weaker $I_L$. For relatively heavier load conditions of stronger $I_L$ it starts increasing with $I_L$, and reaches a maximum $g_{m1(max)}$ for $I_{L(max)}$.

Figure 4B:
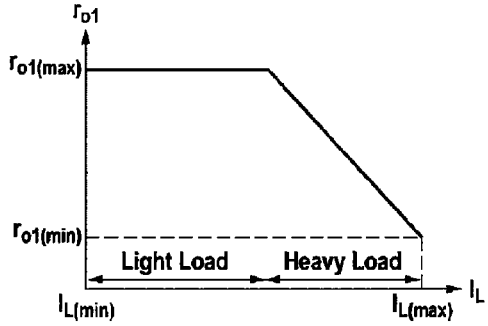

As observed in FIG. 4B, $r_{o1}$ remains at a maximum $r_{o1(max)}$ for relatively lighter load conditions of weaker $I_L$. For relatively heavier load conditions of stronger $I_L$ it starts decreasing with $I_L$, and reaches a minimum $r_{o1(MIN)}$ for $I_{L(max)}$.

The variation of $g_{m1}$ and $r_{o1}$ with $I_L$ is such that their product $g_{m1}$ $r_{o1}$ remains substantially independent of $I_L$. The d.c. gain of the first stage, given by the product $g_{m1}$ $r_{o1}$, is therefore substantially independent of load conditions, an important feature of the invention.

Figure 4C:
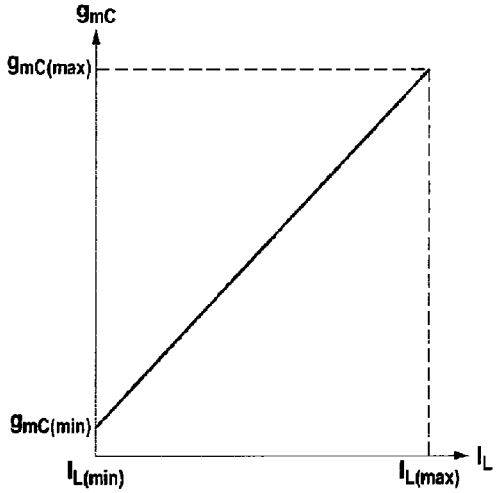
Figure 4D:
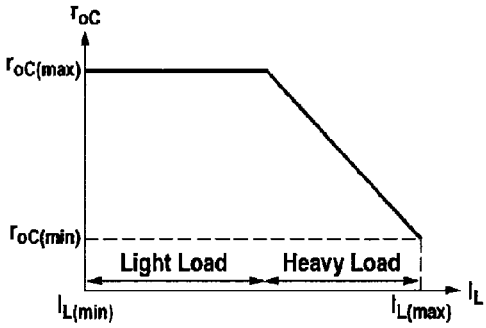

As observed in FIG. 4C, $g_{mC}$ is an increasing function of $I_L$ throughout the entire load range. Preferably, $g_{mC}$ tracks the transconductance $g_{mC}$ of the pass device with a fixed ratio as the latter increases with $I_L$. The minimum and maximum of $g_{mC}$ are represented in FIG. 4C with $g_{mC(min)}$ and $g_{mC}$(max), respectively.

As observed in FIG. 4D, it is notable and an important aspect of the invention that $r_{oC}$ remains at a finite maximum $r_{oC(max)}$ for relatively lighter load conditions of weaker $I_L$.

For relatively heavier load conditions of stronger $I_L$ it starts decreasing with $I_L$, and reaches a minimum $r_{oC(min)}$ for $I_{L(max)}$. $r_{oC}$ is kept smaller than $r_{o1}$ throughout the entire load range.

The variation of $g_{mC}$ and $r_{oC}$ with $I_L$ is such that their product is described for heavy-load conditions by $$g_{mC}r_{oC}=m \tag{1}$$

where m is a design parameter substantially independent of $I_L$. For lighter load conditions, the product $g_{mC}r_{oC}$ is an increasing function of $I_L$ because $g_{mC}$ increases with $I_L$ whereas $r_{oC}$ remains at a finite fixed maximum $r_{oC(max)}$ for such load conditions.

A straightforward small-signal circuit analysis of the linear voltage regulator circuit of FIG. 3 reveals a d.c. LGTF magnitude $A_{LG}$ described by $$A_{LG} = g_{m1}r_{o1}g_{m2}r_{o2}g_{mP}r_o\frac{R_2}{R_1+R_2} \tag{2}$$

where $r_o$ denotes the parallel equivalent of load resistance $R_L$ and the output resistance $r_{oP}$ of pass device.

Analysis also indicates four poles and one zero. The variation of zero and pole frequencies with load current $I_L$ is shown asymptotically in FIG. 5 on a coordinate system of logarithmically calibrated axes. Parametric equations describing the values of these frequencies are also given in FIG. 5 assuming $R_1=0$ and $R_2=\infty$ for the sake of simplicity. The load conditions marked "light load" and "heavy load" correspond to the conditions similarly marked in FIG. 4. The load level $I_{L(crit)}$ shown in FIG. 5 is defined as the load current for which the following condition is met:

$$g_{mC}r_{oC} = \frac{1}{A_2} \tag{3}$$

where $A_2=g_{m2}r_{o2}$ is the second-stage gain.

Figure 5:
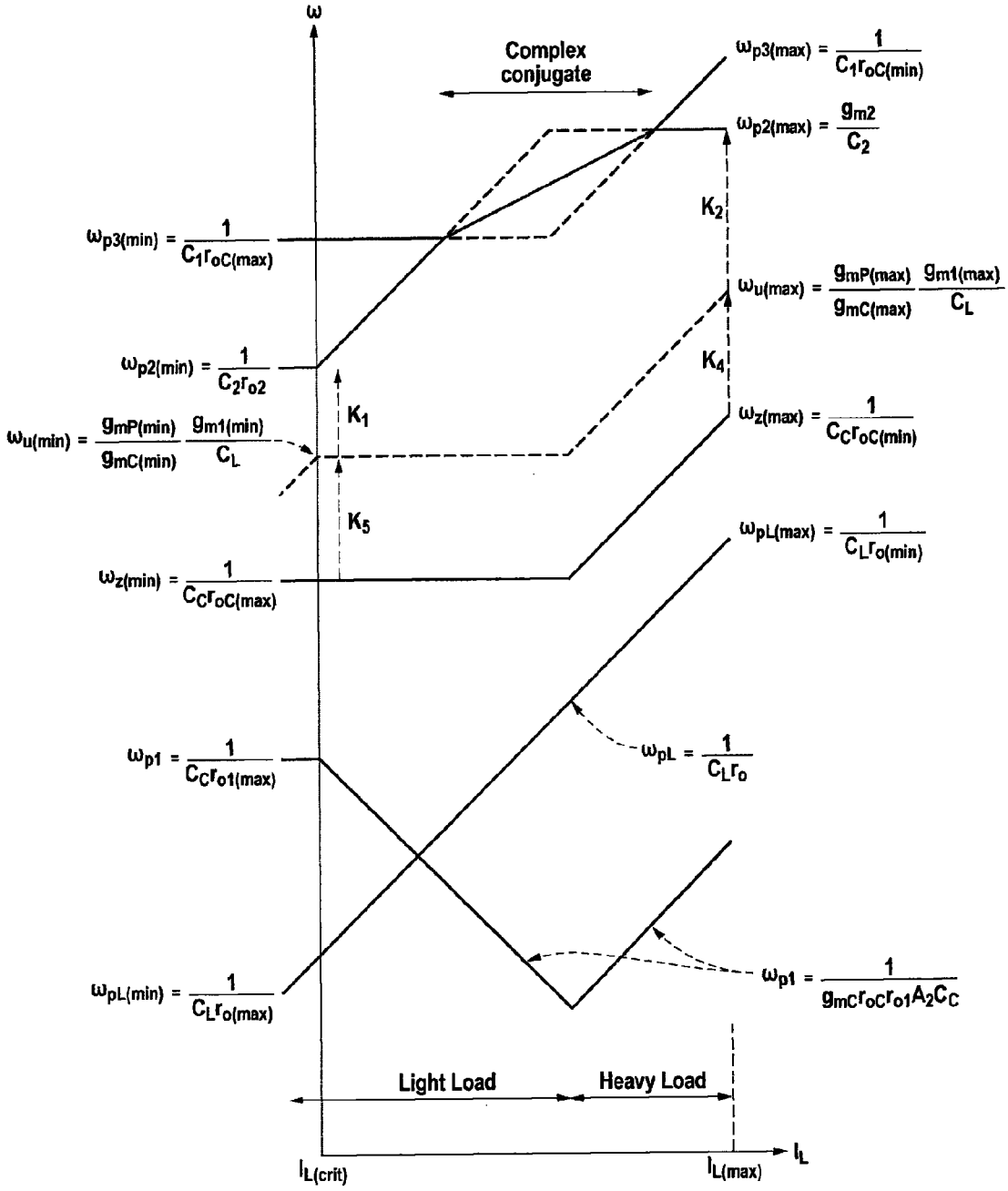
FIG. 5 is a graph showing frequency characteristics from a light load to a heavy load.

Also shown in FIG. 5 in dashed lines is the asymptotic variation of unity-gain frequency $\omega_u$ with $I_L$, together with its parametric equations. As long as the upper frequency $\omega_u$ remains substantially above the two low-frequency poles $\omega_{pL}$ and $\omega_{p1}$ and the zero $\omega_z$ while remaining substantially below the high-frequency poles $\omega_{p2}$ and $\omega_{p3}$ for the entire load range, the linear voltage regulator of the invention will be stable with a phase margin larger than 45°.

For an evaluation of properties, suppose without loss of generality that $I_{L(crit)}$ is set by design to coincide with the minimum load current $I_{L(min)}$, which, according to (3), implies $$g_{mC(min)}r_{oC(max)} = \frac{1}{A_2} \tag{4}$$

It is evident from FIG. 5 that as long as $\omega_{p3}$ remains above $\omega_{p2}$ for both cases of minimum and maximum load, stability will be threatened by the proximity of $\omega_u$ to $\omega_{p2}$ and $\omega_z$ at both extrema of load conditions. The total variation of $\omega_{p2}$ from minimum-load condition to maximum-load condition equals the gain $g_{m2}r_{o2}$ of the second stage. Therefore $\omega_u$ and $\omega_z$ must also vary by a comparable factor in order to maintain stability with comparable phase margins at the two extrema. In the case of $\omega_u$, the necessary variation is provided by the varying $g_{m1}$ because the remaining parameters $g_{mP}/g_{mC}$ and $C_L$ of $\omega_u$ are independent of load conditions as discussed previously. In the case of $\omega_z$, the necessary variation is provided by the varying $r_{oC}$ because the remaining parameter $C_C$ of $\omega_z$ is independent of load conditions as discussed previously.

A close analytical examination of the plots of FIG. 5 together with Equation (1) reveals a constraint in the form of $$\frac{K_2K_4}{K_1K_5} = A_2^2 m \frac{g_{mP(min)}}{g_{mP(max)}} \tag{5}$$

where $K_1=\omega_{p2(min)}/\omega_{u(min)}$, $K_2=\omega_{p2(max)}/\omega_{u(max)}$, $K_5=\omega_{u(min)}/\omega_{z(min)}$, and $K_4=\omega_{u(max)}/\omega_{z(max)}$. These definitions and FIG. 5 show that these four K-factors are the determinants of phase margin at minimum and maximum load conditions. According to (5), only three of these factors can generally be specified independently once the load range represented by the ratio $g_{mP(min)}/g_{mP(max)}$ and the second-stage gain $A_2$ have been specified, and the value of m has been fixed.

For further evaluation of LDO properties, consider without loss of generality a design example starting with specified values of second-stage gain $A_2$, three of the four K-factors of phase margin, maximum unity-gain frequency $\omega_{u(max)}$ as usually imposed by the dynamic regulation specification, and load range in terms of $g_{mP(min)}$ and $g_{mP(max)}$. Also suppose that the values of $C_L$, and $C_2$ are known, m is set, and an estimated value of $C_1$ is available. Design can be completed in the following order:

1. Determine the fourth K-factor from (5) for the specified values of m, $A_2$, $g_{mP(min)}$ and $g_{mP(max)}$.
2. Determine $\omega_{p2(max)}$ from the equation of definition of $K_2$ for the specified $\omega_{u(max)}$ and the specified $K_2$.
3. Determine $g_{m2}$ from the expression of $\omega_{p2(max)}$ in FIG. 5 for the calculated $\omega_{p2(max)}$ and the known value of $C_2$.
4. Determine $r_{o2}$ from $r_{o2}=A_2/g_{m2}$ for the calculated $g_{m2}$ and the specified $A_2$.
5. Determine $\omega_{p2(min)}$ from the expression of $\omega_{p2(min)}$ in FIG. 5 for the calculated $r_{o2}$ and the specified $C_2$.
6. Set $\omega_{p3(min)}$ to be sufficiently higher than $\omega_{p2(min)}$ so that the complex conjugate pair these poles form for medium-load conditions is not harmful to stability.
7. Determine $r_{oC(max)}$ from the expression of $\omega_{p3(min)}$ in FIG. 5 for the calculated $\omega_{p3(min)}$ and the estimated $C_1$.
8. Determine $\omega_{u(min)}$ from the equation of definition of $K_1$ for the calculated $\omega_{p2(min)}$ and the specified $K_1$.
9. Determine $\omega_{z(min)}$ from the equation of definition of $K_5$ for the calculated $\omega_{u(min)}$ and the specified $K_5$.
10. Determine $C_c$ from the expression of $\omega_{z(min)}$ in FIG. 5 for the calculated values of $\omega_{z(mm)}$ and $r_{oC(max)}$.
11. Determine $g_{mC(min)}$ from (4) for the calculated $r_{oC(max)}$ and the specified $A_2$.
12. Determine the ratio $g_{mP(min)}/g_{mC(min)}$ from $g_{mC(min)}$ and the specified value of $g_{mC(min)}$.
13. Equate $g_{mP(max)}/g_{mC(max)}$ to $g_{mC(min)}/g_{mC(min)}$, and use this equation to determine $g_{mC(max)}$ for the calculated $g_{mC(min)}$ and the specified values of $g_{mP(max)}$ and $g_{mC(min)}$.
14. Determine $g_{m1(max)}$ from the expression of $\omega_{u(max)}$ in FIG. 5 for the calculated $g_{mP(max)}/g_{mC(max)}$, the specified $\omega_{u(max)}$, and the known value of $C_L$.
15. Determine $g_{mC(min)}$ from the expression of $\omega_{u(min)}$ in FIG. 5 for the calculated values of $g_{mP(min)}/g_{mC(min)}$ and $\omega_{u(min)}$ and the known value of $C_L$.
16. Determine $\omega_{z(max)}$ from the equation of definition of $K_4$ for the specified $\omega_{u(max)}$ and the specified $K_4$.
17. Determine $r_{oC(min)}$ from (1) for the calculated $g_{mC(max)}$ and specified m.

This example of design flow indicates two important features of the invention. First, a solution exists for any load range as represented by the combination of $g_{mP(min)}$ and $g_{mP(max)}$. Second, first-stage gain can be set to any desired value by way of first-stage output resistance $r_{o1}$, which is not involved in any step of the design flow. Therefore, the method of design according to the invention is capable yielding a stabilized LDO regulator circuit of a very large gain supplied by two cascaded gain stages.

As a further illustration of the properties of the invention, consider the numerical example of a case in which $\omega_{u(max)}=6.28\times10^6$ rad/s, $C_L=1$ μF, $C_2=45$ pF, $C_1=0.45$ pF, $g_{mP(min)}=2\times10^{-4}$ A/V, $g_{mP(max)}=1$ A/V, $K_1=1.5$, $K_2=3$, $K_4=3$, $K_5=6$, $\omega_{p3(min)}/\omega_{p2(min)}=8$, $A_2=37$ dB, and m=1. Following the design flow described above, the parameters of the LDO regulator are determined to be as follows: $g_{m2}=848$ μA/V, $r_{o2}=82.6$ kΩ, $g_{mC(min)}=9.3$ μA/V, $g_{m1(max)}=326$ μA/V, $r_{oC(min)}=19.3$ kΩ, $r_{oC(max)}=1.36$ MΩ, $g_{mC(min)}=10.4$ nA/V, $g_{mC(max)}=51.8$ μA/V, and $C_C=24.3$ pF. Note that the specified value of $g_{mp(max)}/g_{mP(min)}$ is representative of an approximately five decades wide load-current range with an $I_{L(max)}$ of several hundred milliamperes. Furthermore, the specified $\omega_{u(max)}$ and $C_L$ together with this much maximum current typically correspond to a dynamic regulation performance better than a hundred millivolts. Notice that 37 dB is contributed by the second stage to the gain without imposing any restriction on the gain available from the first stage. The design outcome of the example further indicates a compensation capacitor of reasonable footprint, and transconductance values achievable with a bias current no more than a hundred microampere.

Figure 6:
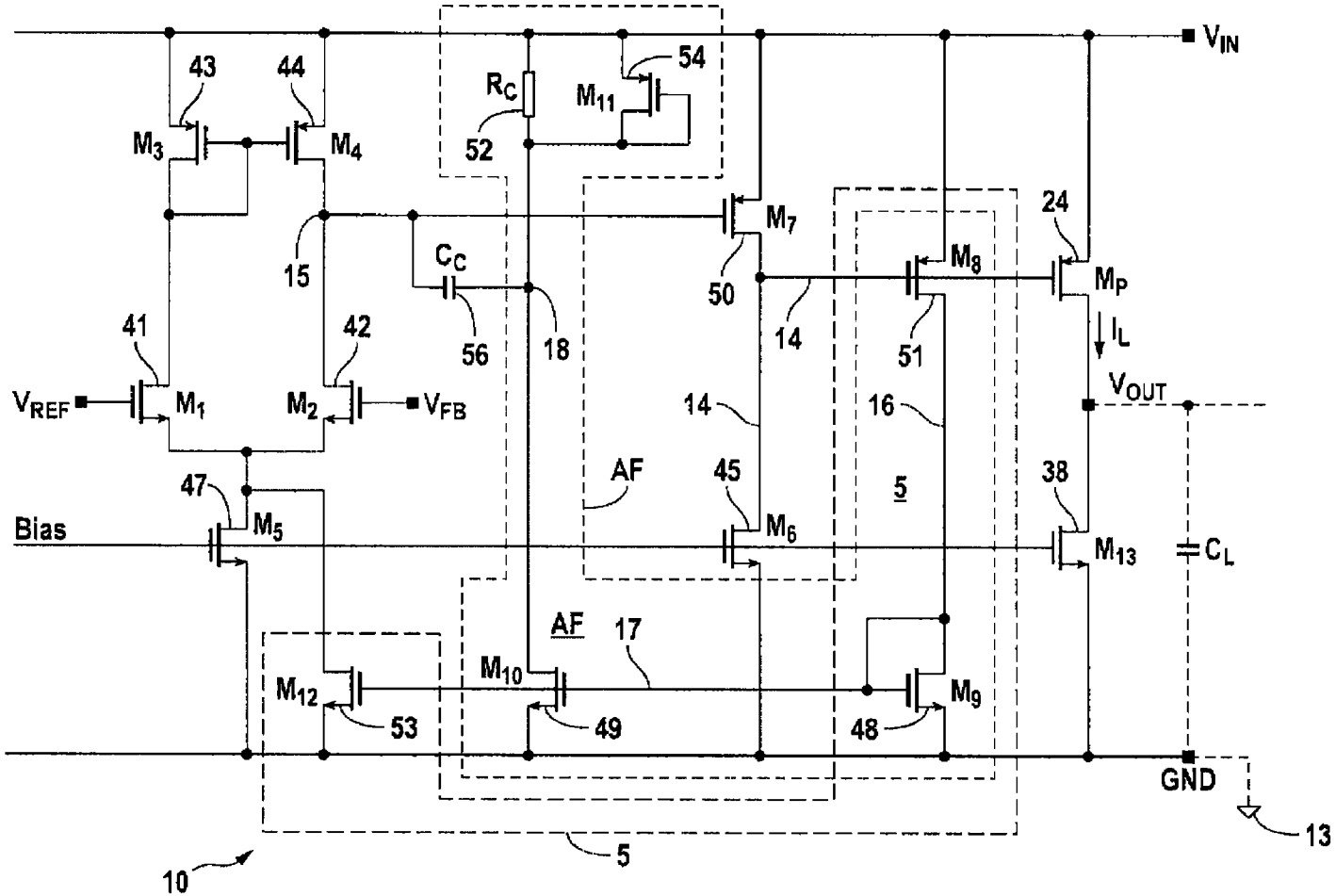
FIG. 6 is a detailed schematic diagram of an error amplifier circuit with a pass device according to the invention as implemented with CMOS technology.

One possible embodiment of the invention in CMOS technology is partially shown in FIG. 6. The schematic depicts the combination of error amplifier $A_{E1}$ and $A_{E2}$ and pass device M. The regulation feedback path and associated network between regulated output point $V_{OUT}$ and regulation feedback input at point $V_{FB}$, as shown in FIG. 3 as trace 12 and optional associated resistors, is omitted for clarity but should be understood to be an integral part of a operating circuit.

First gain stage is a simple differential-input active-loaded transconductance amplifier whose drivers are $M_1$ 41 and $M_2$ 42, and loads are $M_3$ 43 and $M_4$ 44. $M_5$ 47 supplies a constant bias current, which determines $g_{m1(min)}$ and $r_{o1(max)}$). Under heavy load conditions $M_{12}$ 53 contributes additional bias current, which is substantially proportional to the load current $I_L$ of the pass device 24. This is how $g_{m1}$ becomes an increasing function of $I_L$, and how $r_{o1}$ becomes a decreasing function of $I_L$ under heavy load conditions. Note that $I_L$ is sensed by $M_8$ 51 and mirrored by $M_9$ 48 onto $M_{12}$ 53. The function of the current-sensing bias circuit S of FIG. 3 is therefore implemented with $M_g$ 51 and $M_9$ 48 fed by trace 16, while $M_{12}$ 53 fed by trace 17 performs the control function. The first stage can be built according to any other differential-input single-ended-output transconductor topology. For example, a cascoded topology may be deployed for extremely high first-stage gain.

Comparing FIG. 3, the drain terminal of $M_4$ 44 is the node 15 at the output of the first gain stage $A_{E1}$ and the input of the second gain stage $A_{E2}$. Second gain stage $A_{E2}$ is a simple common-source amplifier, which deploys $M_7$ 50 as a driver, and $M_6$ 45 as a current-sink load. The output of this stage taken from the drain terminal of $M_7$ 50 drives the gate of the pass device $M_P$ 24. $M_{13}$ 38 is just a bleeder device continuously sinking the minimum load current $I_{L(min)}$ from $M_p$ 24 even when the load (not shown) of the LDO device 10 is an open circuit.

The transconductor stage $A_F$ of FIG. 3 is implemented in the schematic of FIG. 6 with $M_{10}$ 49, $M_{11}$ 54, $R_C$ 52, $M_8$ 51 and $M_9$ 48. Elements $M_8$ 51 and $M_9$ 48 together with element $M_{12}$ 53 constitute the active elements of current sensing bias circuit S. The transconductance from the gate terminal of $M_8$ 51 to the drain terminal of $M_{10}$ 49 via $M_9$ 48 is what is denoted by $g_{mC}$ in FIG. 3. In terms of individual device transconductances, the minimum and maximum of $g_{mC}$ are given by $$g_{mC(min)} = \frac{(W/L)_{(10)}}{(W/L)_{(9)}} g_{m8(min)} \tag{6}$$

and $$g_{mC(max)} = \frac{(W/L)_{(10)}}{(W/L)_{(9)}} g_{m8(max)} \tag{7}$$

where $(W/L)_{(10)}$ and $(W/L)_{(9)}$ represent the aspect ratio of $M_{10}$ 49 and $M_9$ 48, respectively. In between the minimum and maximum, $g_{mC}$ increases with $I_L$, and closely tracks $g_{mP}$ over the entire load range due to the similar behavior of $g_{m(8)}$.

The output resistance $r_{oC}$ of $A_F$ is the parallel combination of $R_C$ 52 and the inverse transconductance of $M_{11}$ 54. Therefore, $r_{oC}=R_C/(1+R_C g_{m(11)})$. The bias current flowing in $M_{10}$ 49, and therefore in the parallel combination of $R_C$ 52 and $M_{11}$ 54 is just a scaled-down replica of the load current $I_L$. For this reason, it is very small under light load conditions. This small bias current of light load conditions flows mainly through $R_C$ 52 rather than through $M_{11}$ 54. Since $g_{m(11)}$ remains much smaller than $1/R_C$, $r_{oC}$ is determined solely by $R_C$ under light-load conditions. Therefore:

$$r_{oC(max)}=R_C \tag{8}$$

As the bias current flowing in $M_{10}$ 49 increases with $I_L$, more of this current is steered to $M_{11}$ 54. As a consequence, $g_{m(11)}$ exceeds $1/R_C$, and the equivalent resistance is well approximated by $r_{oC}=1/g_{m(11)}$ under heavy-load conditions. Since $g_{m(11)}$ continues to increase with $I_L$, $r_{oC}$ becomes a decreasing function of $I_L$ under heavy-load conditions, and it eventually attains its minimum value:

$$r_{oC(min)} = \frac{1}{g_{m(11)(max)}} \tag{9}$$

for the maximum load condition.

The invention has been explained in respect to specific embodiments. Other embodiments will be evident to those of skill in the art. It is therefore not intended that this invention be limited, except as indicated by the appended claims.

What is claimed is:

1. A linear amplifying regulator suitable as a low dropout voltage regulator comprising:

a pass device for passing current at a voltage that is regulated by a gate voltage at a gate;

an error amplifier coupled to receive a voltage reference signal and to drive the gate of the pass device, said error amplifier comprising a first high-gain stage and a second non-buffering high-gain stage, and a frequency compensation network, said first gain stage and said second gain stage having gain characteristics independent of one another; and said frequency compensation network configured for feedback control of transconductance and output resistance parameters of said first gain stage and of the said frequency compensation network.

2. A multi-stage linear error amplifier with frequency compensation for use with a pass device having a control input to form a device for regulating voltage at a load subject to varying load conditions and varying input voltage conditions said pass device configured for passing current at a voltage that is regulated by a control voltage at said control input, said error amplifier comprising:

a first gain stage having a reference voltage input, a regulated feedback input and an output and coupled to receive parameter control feedback to control transconductance and output resistance characteristics in response to varying load current;

a second gain stage having an input and said error output;

said first gain stage and said second gain stage being characterized by respective gain characteristics greater than unity that are independent of one another; and a frequency compensation network including a compensation capacitor; said frequency compensation network coupled to the input of the second gain stage through said compensation capacitor and coupled with the output of the second gain stage to monitor error voltage in feed back from said error output of said second gain stage, said frequency compensation network including variably controlled transconductance and output resistance;

such that said second gain stage supplies an error voltage to said pass device such that the output across a load of said pass device is stable in frequency and stable in voltage under varying loading and varying input voltages.

3. The error amplifier of claim 2 wherein said frequency compensation network further includes a current sensing bias network coupled to sense current of said pass device to control transconductance and output resistance parameters of said first gain stage and to control transconductance and output resistance parameters of said frequency compensation network.

4. A multi-stage linear voltage regulator with frequency compensation for regulating voltage at a load subject to varying load conditions and varying input voltage conditions, said voltage regulator comprising:

a pass device having a gate and a source and a drain, said gate for receiving an error output;

a first gain stage having a reference voltage input, a regulated feedback input and an output and coupled to receive parameter control feedback to control transconductance and output resistance characteristics in response to varying load current;

a second gain stage having an input and said error output;

said first gain stage and said second gain stage being characterized by respective gain characteristics greater than unity that are independent of one another; and a frequency compensation network including a compensation capacitor; said frequency compensation network coupled to the input of the second gain stage through said compensation capacitor and coupled with the output of the second gain stage to monitor error voltage in feed back from said error output of said second gain stage, said frequency compensation network including variably controlled transconductance and output resistance;

such that said second gain stage supplies an error voltage to said pass device such that the output across a load of said pass device is stable in frequency and stable in voltage under varying loading and varying input voltages.

5. The voltage regulator of claim 4 wherein said frequency compensation network further includes a current sensing bias network coupled to sense current of said pass device to control said transconductance and said output resistance parameters of said first gain stage and to control said transconductance and said output resistance parameters of said frequency compensation network.

6. The voltage regulator of claim 4 wherein said varying output resistance parameter is not a decreasing function of load over the output load range and is subject to a maximum fixed resistance value for lower loads.

* * * * *